US005381924A

United States Patent [19]

Kiefel

[11] Patent Number: 5,381,924

[45] Date of Patent: Jan. 17, 1995

[54] NON-SPILL DRINKING VESSEL

[75] Inventor: Stanley A. Kiefel, Fairfield, Ohio

[73] Assignee: Carol A. Kiefel, Fairfield, Ohio

[21] Appl. No.: 214,695

[22] Filed: Mar. 18, 1994

[51] Int. Cl.[6] ..... B65D 53/00; A47G 19/22

[52] U.S. Cl. ..... 220/709; 220/705; 220/378; 215/1 A; 215/229; 229/103.1

[58] Field of Search ..... 220/703, 705, 708, 709, 220/378; 215/1 A, 229; 229/103.1; 222/464, 542

[56] References Cited

U.S. PATENT DOCUMENTS

| | | | |
|---|---|---|---|
| D. 318,427 | 7/1991 | Sherburne, Jr. . | |
| D. 324,824 | 3/1992 | Hansen | D9/436 |
| D. 327,848 | 7/1992 | Hanover | D9/436 |
| 2,948,453 | 8/1960 | Drown . | |
| 4,494,668 | 1/1985 | Lottick . | |
| 4,714,173 | 12/1987 | Ruiz . | |
| 4,730,583 | 3/1988 | Stritzke | 277/184 X |
| 4,911,315 | 3/1990 | Schrum | 215/229 |
| 4,948,009 | 8/1990 | Sawatani | 220/229 |
| 5,018,635 | 5/1991 | Whittaker | 215/229 X |
| 5,044,512 | 9/1991 | Giancaspro et al. | 215/1 A X |
| 5,071,019 | 12/1991 | Sizemore | 220/709 |
| 5,105,975 | 4/1992 | Patterson | 220/709 |
| 5,261,677 | 11/1993 | Gotoh et al. | 277/206 A |
| 5,282,541 | 2/1994 | Chen | 215/229 |

*Primary Examiner*—Allan N. Shoap
*Assistant Examiner*—Vanessa Caretto
*Attorney, Agent, or Firm*—Charles R. Wilson

[57] ABSTRACT

A reuseable non-spill drinking vessel is adapted to be used with a straw. The drinking vessel comprises an open-top container for holding a liquid and a removable lid which is configured to fit over the open-top container to effectively contain liquid therein. The lid has an orifice for receiving a straw and further the orifice has a sealing means which sealingly encompasses the straw in a liquid-tight manner.

10 Claims, 2 Drawing Sheets

NON-SPILL DRINKING VESSEL

This invention relates to a non-spill drinking vessel. More particularly, the invention relates to a non-spill drinking vessel adapted to be drunk from with a straw.

Drinking vessels come in many forms. Tumblers, glasses, mugs and cups are everyday examples of drinking vessels which have been used for many years. They are usually open-top containers which are readily filled and drunk from. Bottles and especially aluminum cans for holding beer and soda pop are more recent examples of drinking vessels. They typically are filled and then are sealed close for shipping. The consumer simply removes the cap or, in the case of soda pop cans, removes a pull-tab.

Spilling a liquid from a drinking vessel is very annoying at any time. However, some spills such as on counter tops or other non-porous surfaces at home are readily cleaned up. No harm is done. All that is needed to prevent future spills is a greater exercise of care by the user. There are situations, though, where an accidental spill from a drinking vessel is not only more likely to happen, but also is more inconvenient to clean up. For example, drinking from an open-top container, even a bottle or soda pop can, in a moving vehicle is likely to result in a spill because of bumps in the road or possibly sudden stops. Spills in food establishments and theaters also tend to occur frequently due in part to less care being exercised by the patron. Toddlers, hospital patients and nursing home residents also tend to have more spill problems with drinking vessels. Added care by these people may not be possible because of immaturity or lessened hand motor skills.

The use of a drinking straw to draw liquid from a drinking vessel reduces the chances of a spill by many individuals, including toddlers and individuals with reduced hand motor skills. The straws are beneficial also to those who enjoy drinking while driving or as a passenger in a motor vehicle, train, airplane or boat. A throw away straw which has been hermetically wrapped is also viewed as more sanitary by many people. However, even with the aid of a straw, accidental spills are still likely with certain groups of people. The problem has been recognized. Many attempts to produce a spill-proof drinking vessel have been made. Examples of drinking vessels which have been especially adapted to accommodate a straw in a non-spill manner are found in the following patents: U.S. Pat. Nos. 2,948,453; 3,295,715; 4,494,668; 4,714,173; and 4,830,204. Certain of the aforedescribed drinking vessels are complex in design and necessarily are only useful in a small market where cost is not a major concern. Other of the aforedescribed drinking vessels simply are too cumbersome to use.

Despite being a long recognized problem and despite there being several attempts to solve the problem, there still remains a need for a non-spill drinking vessel. The non-spill drinking vessel of this invention meets many of the needs recognized, but not previously met. In accord with the invention, there has been developed a drinking vessel which is adapted to be drunk from with the aid of a straw. It is economically produced. It is conveniently filled. Most importantly, the drinking vessel of the invention has a non-spill feature which allows it to be used even by toddlers and those individuals with impaired or diminished hand motor skills.

SUMMARY OF THE INVENTION

A non-spill drinking vessel adapted for use with a straw comprises an open-top container for holding a liquid and a removable lid configured to fit over the container's open-top. The lid has an orifice for receiving a straw. The orifice has operably associated with it a sealing means for the straw which sealingly encompasses the straw in a liquid-tight manner. The lid and sealing means are such that any liquid within the container is contained in a non-spill manner.

DETAILED DESCRIPTION OF THE INVENTION

The non-spill reuseable drinking vessel of the invention is described in detail below and with reference to the drawings. The drinking vessel utilizes all manner of containers in various sizes, shapes and materials of construction. For example, containers having a liquid capacity of from about four ounces to about thirty-two ounces and having a generally frusto-conical shape are very popular and are utilized in the invention. Other shapes such as cylindrical-shaped with or without narrowed necks are as well useful. Waxed paper, plastic, glass and metal such as aluminum are typical materials used in manufacturing the container used in the drinking vessels of the invention.

The non-spill drinking vessel herein comprises an open-top container and a removable lid as its essential components. These components and the drinking vessel's manner of use are described in the following paragraphs.

Figure 1:
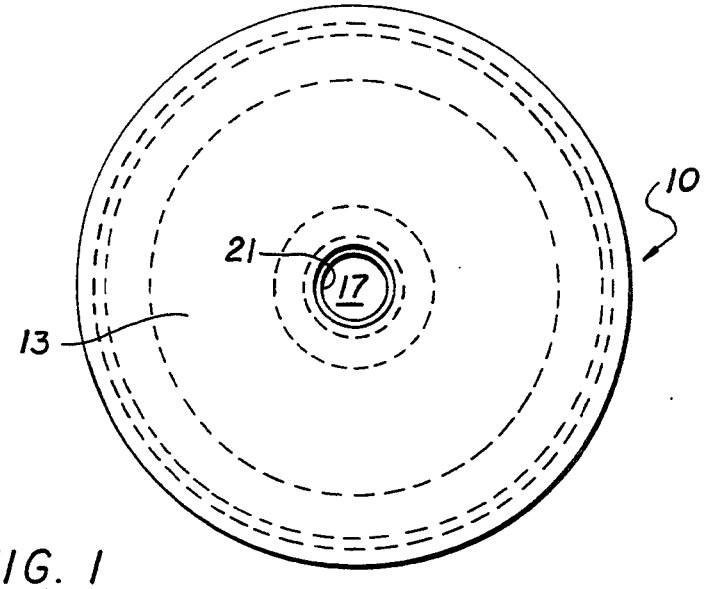
FIG. 1 is a top view of a non-spill drinking vessel of the invention showing its removable lid.
Figure 3:
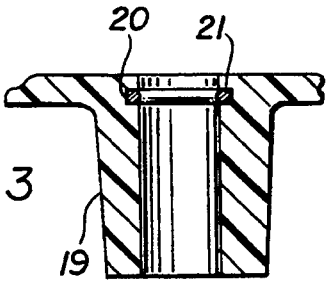
FIG. 3 is an enlarged view of an orifice in the removable lid of the non-spill drinking vessel of FIG. 2 illustrating its straw sealing means.
Figure 2:
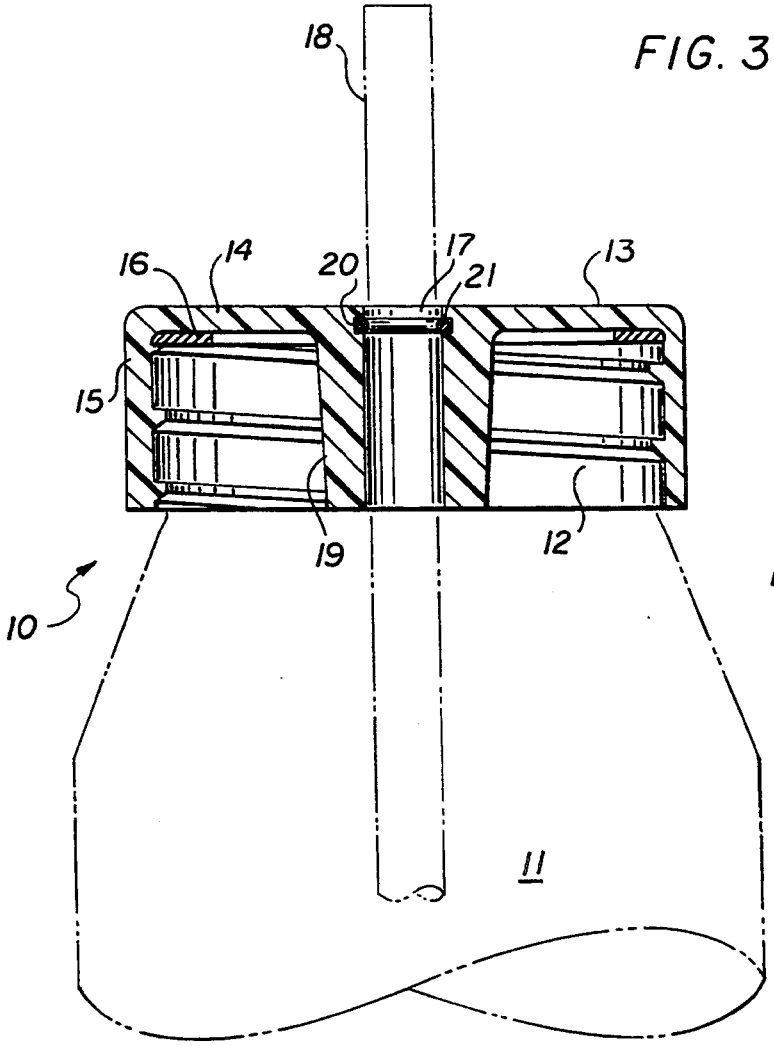
FIG. 2 is an elevation view partially in section of the non-spill drinking vessel of FIG. 1.

With reference to FIGS. 1–3, there is shown a non-spill reuseable drinking vessel 10 of the invention. An open-top container 11, shown in phantom in FIG. 2 is a plastic bottle. Such containers are well known and widely used in commerce. The drinking vessel 10 includes a removable lid 13 which is configured to fit over the container's open-top to effectively contain the liquid within the container. As shown in FIG. 2, the lid 13 has a substantially flat circular-shaped body 14 with an annular flange 15 extending downwardly therefrom. The annular flange is internally threaded on the interior surface 12 to engage the narrowed and externally threaded container neck (not shown). Optionally a gasket 16 is positioned around the inside periphery of the lid to engage the container's top edge to ensure against any leakage.

The removable lid 13 has a centrally disposed orifice 17 in its flat circular-shaped body 14 to receive a straw 18 (shown in phantom in FIG. 2). An internal annular wall 19 extending from the flat circular-shaped body 14 of the lid 13 defines the orifice 17 and serves as the straw passageway. Preferably, the internal annular wall 19 extends downwardly to approximately the same length as the annular flange 15. Ideally, the lid 13 is produced from plastic by a molding process to ensure close manufacturing tolerances and to minimize costs.

The internal annular wall 19 of the removable lid 13 has a sealing means to sealingly encompass the straw in a liquid-tight manner. As best seen in FIG. 3, the internal annular wall 19 has a circumferentially extending groove 20 to receive an O-ring 21. The O-ring is dimensioned to seat into the groove 20 and to allow a conventional straw to readily pass through the lid and into the container, yet provide a liquid-tight seal. The O-ring encompasses the straw and provides a good continuous seal. While one O-ring is sufficient for the purpose contemplated, a series of two or more O-rings positioned along the length of the annular wall provides enhanced sealing with the straw. Conventional elastomeric and synthetic rubber materials are used in forming the O-ring.

Figure 4:
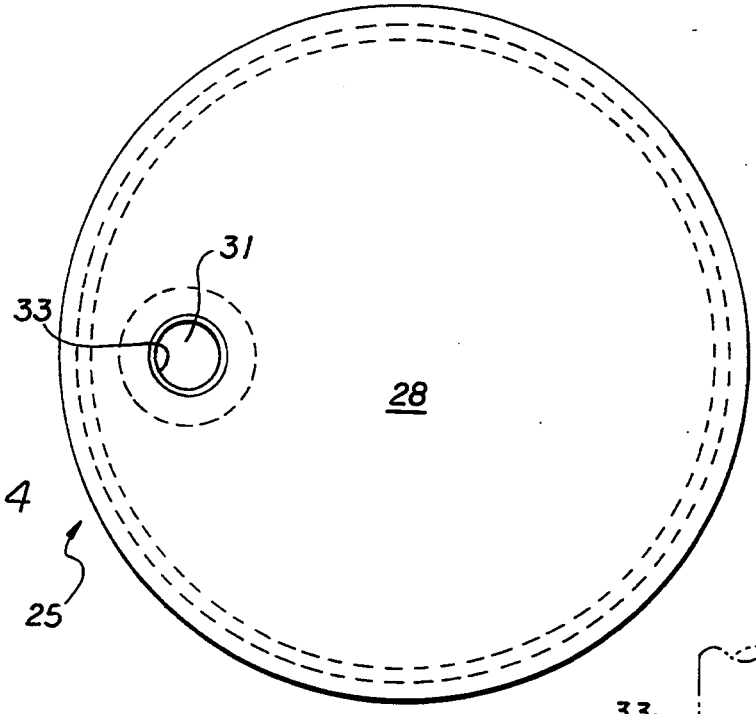
FIG. 4 is a top view of another non-spill drinking vessel of the invention.
Figure 5:
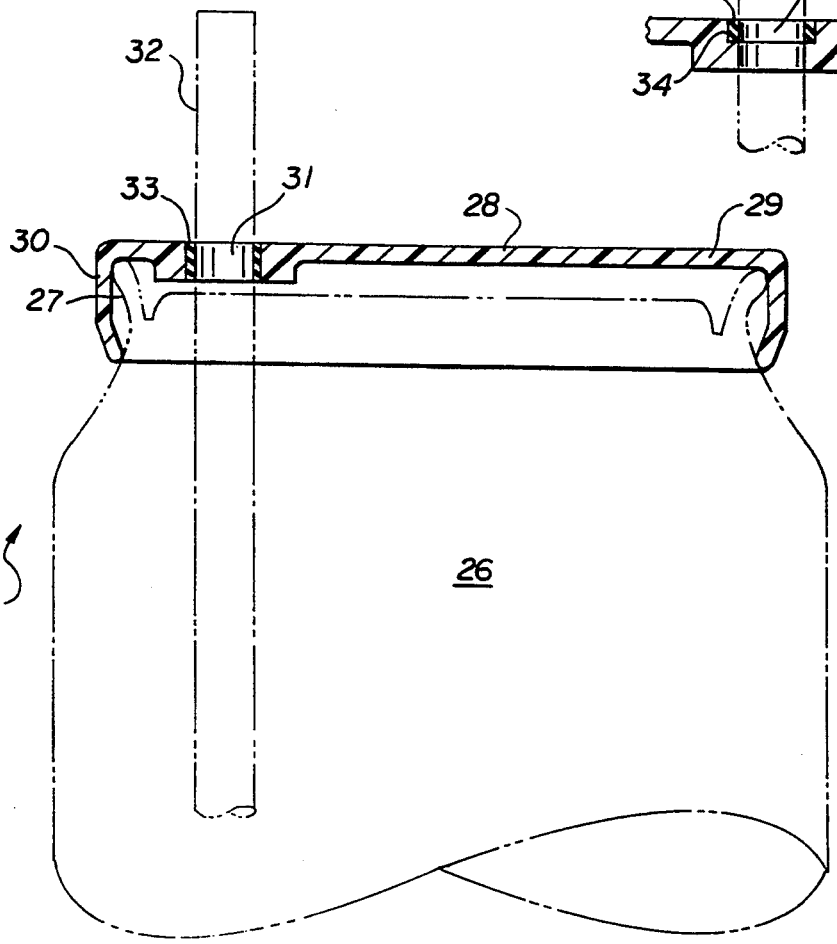
FIG. 5 is an elevational view partially in section of the non-spill drinking vessel of FIG. 4.

FIGS. 4 and 5 illustrate another embodiment of the invention. The container of the drinking vessel 25 is an aluminum soda pop can with a cylindrical-shaped body and flattened bottom wall and top wall. The can is fabricated with a pull-tab in its top wall which is attached to a scored break-out member. The pull-tab when removed, creates an open-top container 26. As is typical, the container 26 has a flared rim 27. A removable lid 28 has a substantially flat circular-shaped body 29 dimensioned to cover the container's top wall and also has a snap-on annular flange 30 which is dimensioned to fit over the flared rim of the container 26 and engage the side wall of the container in a liquid-tight manner. For this purpose, the annular flange 30 is flared inwardly near its terminus to better engage the container's side wall.

Figure 6:
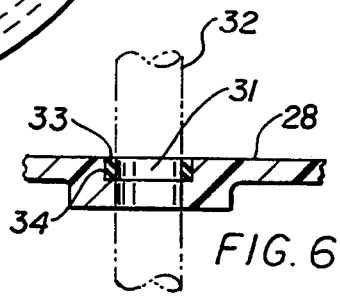
FIG. 6 is an enlarged partial view of a preferred embodiment of the removable lid of the non-spill drinking vessel of FIG. 5.

An orifice 31 in the removable lid 28 is positioned off-center to overly the pull-tab opening in the container 26. The orifice 31 is dimensioned to receive a straw 32 (shown in phantom in FIG. 5) and a gasket 33 which lines the orifice and sealingly engages the straw in a liquid-tight manner. The gasket is adhesively secured to the wall forming the orifice. As shown in FIG. 6, a recessed annular area 34 is preferably provided in the wall forming the orifice to receive the gasket to better ensure against its dislodgement by the straw's movement into and out of the orifice. Elastomer materials are ideally suited as the gasket.

The lid of the drinking vessel 25 illustrated in FIGS. 4 and 5 can be made of an elastomeric gasket material. As such, the flat circular-shaped body, annular flange and sealing means for the orifice are integral. Such lids, though, are less preferred herein due to the fact they are more difficult to use and to clean for reuse.

The drinking vessels of the invention hold liquids in a liquid-tight manner while capable of being drunk from with a straw. It should be evident that any tipping or dropping of a vessel from the user's grasp will not create a spill. The lids and the straw-engaging sealing means provided in the lid ensure that liquid will not spill from the containers. Any leakage which may occur will be through the straw itself and will be minimal. It should also be evident that the drinking vessel is economical to produce, durable in use, and most importantly, reliable in use.

In operation, the container of the type which inherently has an open-top is filled with a liquid. The lid is secured to the container and then the straw forced through the orifice until its end approaches the bottom of the container. The user now drinks from the container in a normal fashion without fear of spilling its contents. After use, the straw is discarded. Next, the lid and container components of the drinking vessel are separated. They are washed, dried and stored until needed again. The containers which have a pull-tab opening are shipped from the plant as a sealed enclosure. Such a container is made open-top simply by removing or at least bending back the pull-tab. The lid is secured to the container and used as aforedescribed.

While the drinking vessels of the invention have been described in detail above, it should be understood that modifications can be made. All such modifications of an obvious nature are considered within the scope of the appended claims.

We claim:

1. A non-spill reuseable drinking vessel for holding liquid and which is capable of being drunk from by use of a straw, said drinking vessel comprising:

(a) an open-top container for holding the liquid; and (b) a removable lid configured to fit over the container's open-top to effectively contain the liquid therein, wherein the lid has an orifice for readily receiving a straw and further wherein the orifice is defined by an internal annular wall which extends downwardly from the lid with a groove extending circumferentially thereinaround with an O-ring in the groove so as to be capable of sealingly encompassing the straw in a liquid-tight manner such that the drinking vessel retains liquid therein in a non-spill manner.

2. The non-spill reuseable drinking vessel of claim 1 wherein the container has external threads near its open-top and the removable lid has internal threads so as to threadably engage the container in a liquid-tight manner.

3. The non-spill drinking vessel of claim 2 wherein the removable lid has a substantially flat circular-shaped body and an annular flange extending downwardly therefrom.

4. The non-spill drinking vessel of claim 3 wherein the annular flange and the internal annular wall extend downwardly from the flat circular-shaped body of the lid an approximately equal distance.

5. A non-spill reuseable drinking vessel for holding liquid and which is capable of being drunk from by use of a straw, said drinking vessel comprising:

(a) an open-top container with a narrowed neck for holding the liquid, said narrowed neck having external threads; and (b) a removable lid configured to fit over the container's open-top and having internal threads so as to threadingly engage the external threads of the open-top container to effectively contain the liquid therein, wherein the lid has an orifice for readily receiving a straw and further wherein the orifice is defined by an internal annular wall which extends downwardly from the lid and which has a groove extending circumferentially thereinaround with an O-ring in said groove to sealingly encompasses the straw in a liquid-tight manner such that the drinking vessel retains liquid therein in a non-spill manner.

6. The non-spill drinking vessel of claim 5, wherein the removable lid has a substantially flat circular-shaped body and an annular flange extending downwardly therefrom with the internal threads therein.

7. A non-spill reuseable drinking vessel for holding liquid and which is capable of being drunk from by use of a straw, said drinking vessel comprising:

(a) an open-top container with a flat top and a flared rim for holding the liquid, further said container has a pull-tab scored area which when pulled forms the open-top; and (b) a removable lid configured to fit over the flared rim of the open-top container to effectively contain the liquid therein, wherein the lid has an orifice for readily receiving a straw and further wherein the orifice is lined with a gasket to sealingly encompasses the straw in a liquid-tight manner such that the drinking vessel retains liquid therein in a non-spill manner.

8. The non-spill drinking vessel of claim 7 wherein the removable lid has a substantially flat circular body and an annular snap-on flange extending therefrom.

9. The non-spill drinking vessel of claim 8 wherein the removable lid further has a recessed area in the orifice to seat the gasket to aid in its retention during use.

10. The non-spill drinking vessel of claim 8 wherein the gasket is adhesively secured to a wall forming the orifice to aid in its retention during use.

* * * * *